US010283921B1

(12) United States Patent
Hidegh et al.

(10) Patent No.: US 10,283,921 B1
(45) Date of Patent: May 7, 2019

(54) ADAPTER FOR USE WITH ONE OR MORE CONNECTORS

(71) Applicant: Fluke Corporation, Everett, WA (US)

(72) Inventors: Stefan Hidegh, Brunn am Gebirge (AT); Alois Sommer, Leobersdorf (AT); Paul Kral, Brunn am Gebirge (AT); Matthew Carl-Robert Bannister, Lake Stevens, WA (US)

(73) Assignee: Fluke Corporation, Everett, WA (US)

( * ) Notice: Subject to any disclaimer, the term of this patent is extended or adjusted under 35 U.S.C. 154(b) by 0 days.

(21) Appl. No.: 15/863,709

(22) Filed: Jan. 5, 2018

(51) Int. Cl.
*H01R 13/52* (2006.01)
*H01R 31/06* (2006.01)
*H01R 27/02* (2006.01)

(52) U.S. Cl.
CPC ..... *H01R 31/06* (2013.01); *H01R 13/5219* (2013.01); *H01R 27/02* (2013.01)

(58) Field of Classification Search
CPC ..... H01R 31/06; H01R 9/0524; H01R 27/02; H01R 13/5219
USPC ..... 439/271
See application file for complete search history.

(56) References Cited

U.S. PATENT DOCUMENTS 5,944,056 A * 8/1999 Miyazoe ..... F16K 27/003 137/625.64
6,367,507 B1 * 4/2002 Legeai ..... F16L 3/24 137/360
7,222,642 B2 * 5/2007 DuHack ..... F16K 31/0651 137/883
9,803,765 B2 * 10/2017 Inaba ..... F15B 13/0821
2015/0180142 A1 * 6/2015 Tremba ..... H01R 9/0524 439/578

* cited by examiner

*Primary Examiner* — Jean F Duverne
(74) *Attorney, Agent, or Firm* — Seed Intellectual Property Law Group LLP

(57) ABSTRACT

Generally described, embodiments are directed to an adapter for use with one or more connectors for coupling to an electronic device. The adapter receives the one or more separate connectors to form a connector assembly that is configured to be inserted into one or more sockets of an electronic device, such as an energy logger device. In at least one embodiment, the adapter includes one or more sealing rings that improve the sealing between the respective one or more connectors and one or more sockets to improve the integrity of the electrical coupling therebetween.

20 Claims, 10 Drawing Sheets

ADAPTER FOR USE WITH ONE OR MORE CONNECTORS

BACKGROUND

Technical Field

Embodiments are directed to an adapter for use with one or more connectors for coupling to an electrical device, such as an electronic measurement device.

Description of the Related Art

The integrity of an electrical coupling of an electric device between a connector and a socket varies widely. In some situations, the electrical coupling must meet particular standards. For instance, electronic measurement devices in moist and/or dirty environments, such as an energy logger used outdoors for measuring power lines, have to meet particular standards for test and measurement.

IP ratings (Ingress Protection or International Protection ratings) define standards for electrical couplings for test and measurement devices and are defined by European standard of EN 60529 (British BS EN 60529:1992, international IEC 60509:1989). In particular, these standards are used to evaluate electrical couplings between components to prevent against intrusion, such as by debris and fluid.

In general, IP ratings include two digits, the first digit stands for the level of protection the enclosure provides against solid bodies, while the second digit describes the degree of protection of the equipment inside the enclosure against-liquid. Thus, for IP65, the first digit 6 indicates the level of protection for solids, while the second digit 5 indicates the level of protection for liquids. More particularly, a level 6 for solids requires protection against dust that may harm equipment, while a level 5 for liquids requires a protection from water spray from all directions.

There is a need for improved coupling between various electrical components to meet the IP65 standard.

BRIEF SUMMARY

Generally described, embodiments are directed to an adapter for use with one or more connectors for electrically coupling to an electronic device. The adapter receives the one or more connectors to form a connector assembly that is configured to be inserted into one or more sockets of an electronic device, such as an electronic measurement device. In at least one embodiment, the adapter includes a sealing ring that improves the sealing of the electrical coupling between the connector and the socket and minimizes the amount and size of fluid or debris that may interfere with the electrical coupling. In at least one embodiment, the adapter improves the coupling of the connectors when the connectors are inserted into the electronic device, such as an electronic measurement device, such that the electrical connection meets the standards of IP65 as referred to above.

One embodiment is directed to a connector assembly comprising an adapter including at least one adapter element. The at least one adapter element includes a coupling portion, a protrusion coupled to the coupling portion, and a through hole extending through the at least one adapter element from the coupling portion to the protrusion. The protrusion includes an outer surface, and a sealing ring located on the outer surface of the protrusion. The connector assembly further includes a separate connector removably coupled to the coupling portion of the at least one adapter element. The connector includes a lead located in the through hole. A surface of the lead in the through hole is spaced apart from an inner surface of the protrusion.

Another embodiment is directed to an electronic device comprising a socket and an adaptor. The socket includes a conductive element that is electrically coupled to an electrical component of the electronic device. The adapter has a protrusion, a coupling portion, and a through hole extending through the coupling portion and protrusion. The protrusion has an outer surface and a sealing ring located on the outer surface of the protrusion. The electronic device further includes a separate connector removably inserted into the through hole of the adapter and forming a connector assembly. The connector includes a conductive lead extending inside of the protrusion. A portion of the connector assembly is inserted into the socket such that the conductive lead of the connector is electrically coupled to the conductive element of the socket. The sealing ring is compressed between an inner wall of the socket and the outer surface of the protrusion of the adapter and provides a sealing engagement with the inner wall of the socket.

Another embodiment is directed to a connector assembly comprising an adapter including a plurality of adapter elements coupled together by a main body. Each of the plurality of adapter elements includes a protrusion having an outer surface, a through hole extending through the protrusion, and a sealing ring located on an outer surface of the protrusion. The connector assembly further includes a plurality of separate connectors removably coupled to the plurality of adapter elements, respectively. The plurality of connectors includes leads that are located in the through holes of the protrusions, respectively. Surfaces of the leads in the through holes are spaced apart from inner surfaces of the protrusions.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

In the following description, certain specific details are set forth in order to provide a thorough understanding of various disclosed embodiments. However, one skilled in the relevant art will recognize that implementations may be practiced without one or more of these specific details, or with other methods, components, materials, etc. In other instances, well-known structures of an electronic device, such as an electronic measurement device as described herein, and the associated connectors have not been shown or described in detail to avoid unnecessarily obscuring descriptions of the embodiments.

Generally described, embodiments are directed to an adapter for use with one or more connectors for coupling to an electronic device. The adapter receives the one or more connectors to form a connector assembly that is configured to be inserted into one or more sockets of an electronic device, such as, but not limited to, an energy logger device. In at least one embodiment, the adapter includes a sealing ring that improves the sealing of the electrical coupling between the connector and the socket. The adapter improves the sealing between the connector and the socket to minimize the amount and size of fluid or debris that can disrupt the electrical coupling therebetween. In at least one embodiment, the adapter improves the coupling of the connectors when the connectors are inserted into the electronic device, such that the electrical connection meets the requirements of a third-party defined ingress protection standard, such as the requirements of an IP65 rating under the IEC (EN) 60529 standard.

Figure 1A:
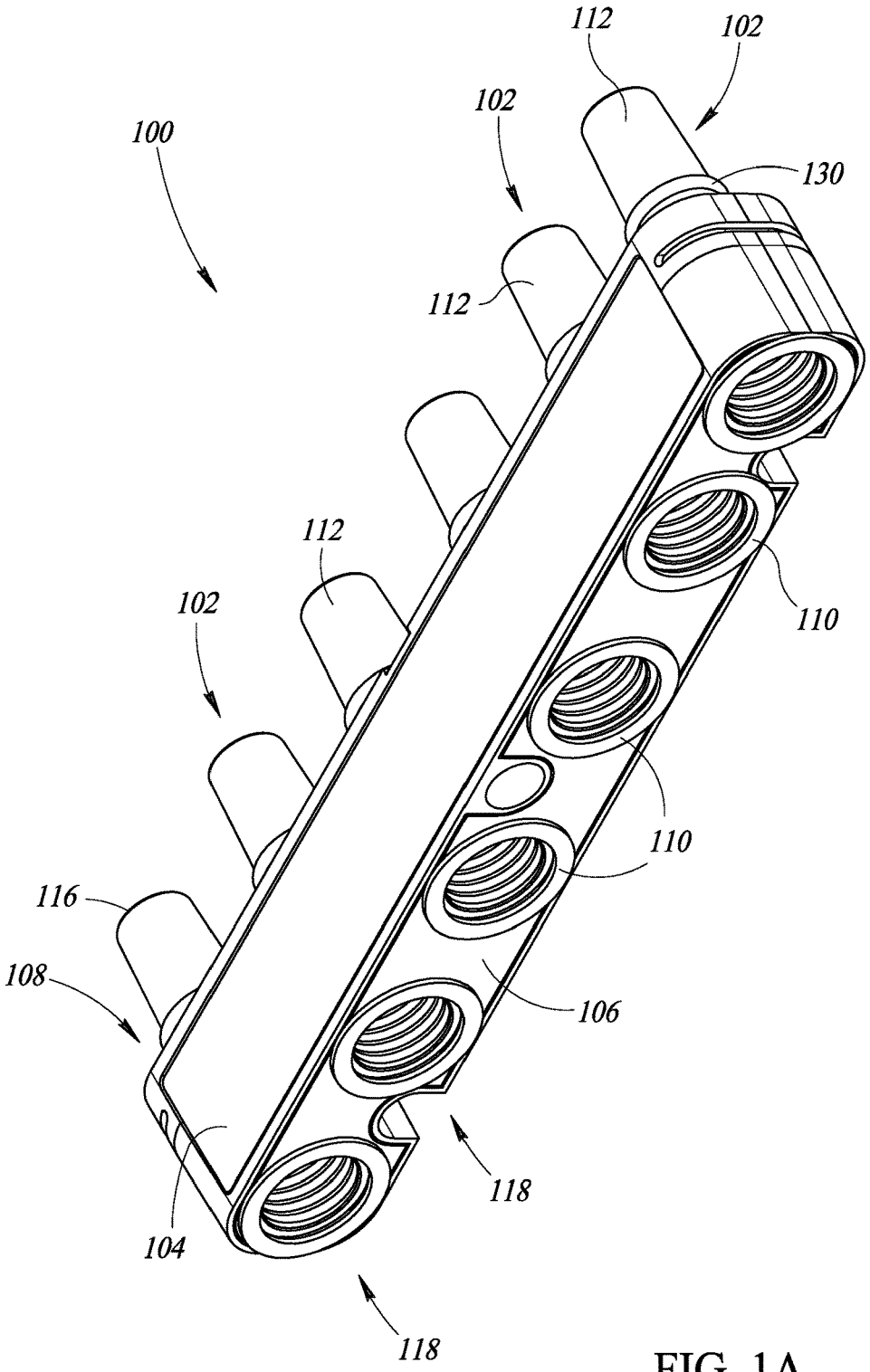
FIG. 1A is a schematic illustration of an isometric view of an adapter in a first orientation in accordance with one embodiment.
Figure 1B:
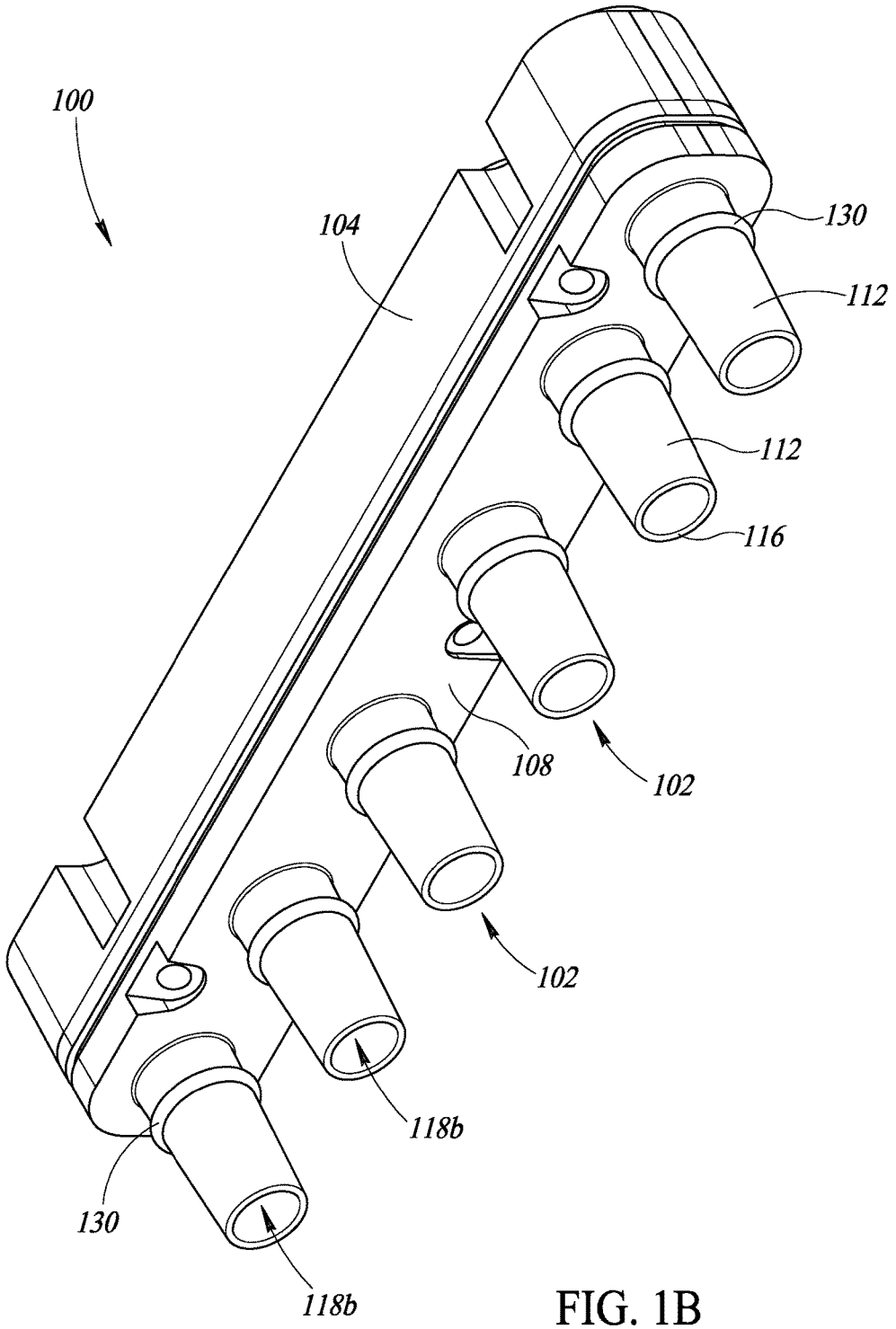
FIG. 1B is a schematic illustration of an isometric view of the adapter of FIG. 1A in a second, opposite orientation.
Figure 1C:
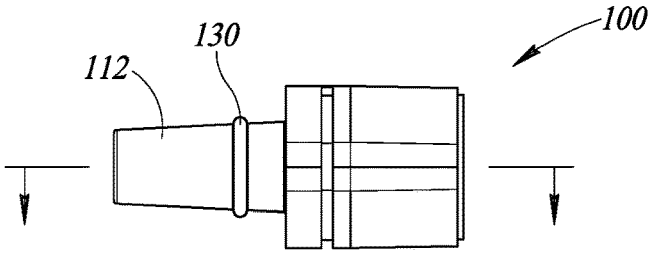
FIG. 1C is a schematic illustration of a side view of the adapter of FIG. 1A.

FIGS. 1A-1D are various views of an adapter 100 in accordance with one embodiment. In particular, FIG. 1A is a schematic illustration of an isometric view of the adapter 100 in a first orientation; FIG. 1B is a schematic illustration of an isometric view of the adapter 100 of FIG. 1A in a second, flipped or opposite orientation; FIG. 1C is a schematic illustration of a side view of the adapter 100 of FIG. 1A; and Figure ID is a schematic illustration of a cross-sectional view of the adapter 100 of FIG. 1C.

Generally described, the adapter 100 includes a plurality of adapter elements 102 that are coupled together by a main body 104 having a first surface 106 as best shown in FIG. 1A and a second, opposite surface 108 as best shown in FIG. 1B. Each adapter element 102 includes a coupling portion 110 at the first surface 106 and a protrusion 112 that extends from the second surface 108. The protrusions 112 extend from the second surface 108 of the main body 104 at a base and have end surfaces 116 that face away from the main body 104. The protrusions 112 may be tapered such that the ends 116 of the protrusions 112 have a cross-sectional dimension (e.g., diameter) that is narrower than the bases of the protrusions 112. The protrusions 112 are of a suitable size and configuration for being inserted into sockets of an electronic device, such as an electronic measurement device, as will be explained in more detail with reference to FIGS. 3A-3D.

Figure 1D:
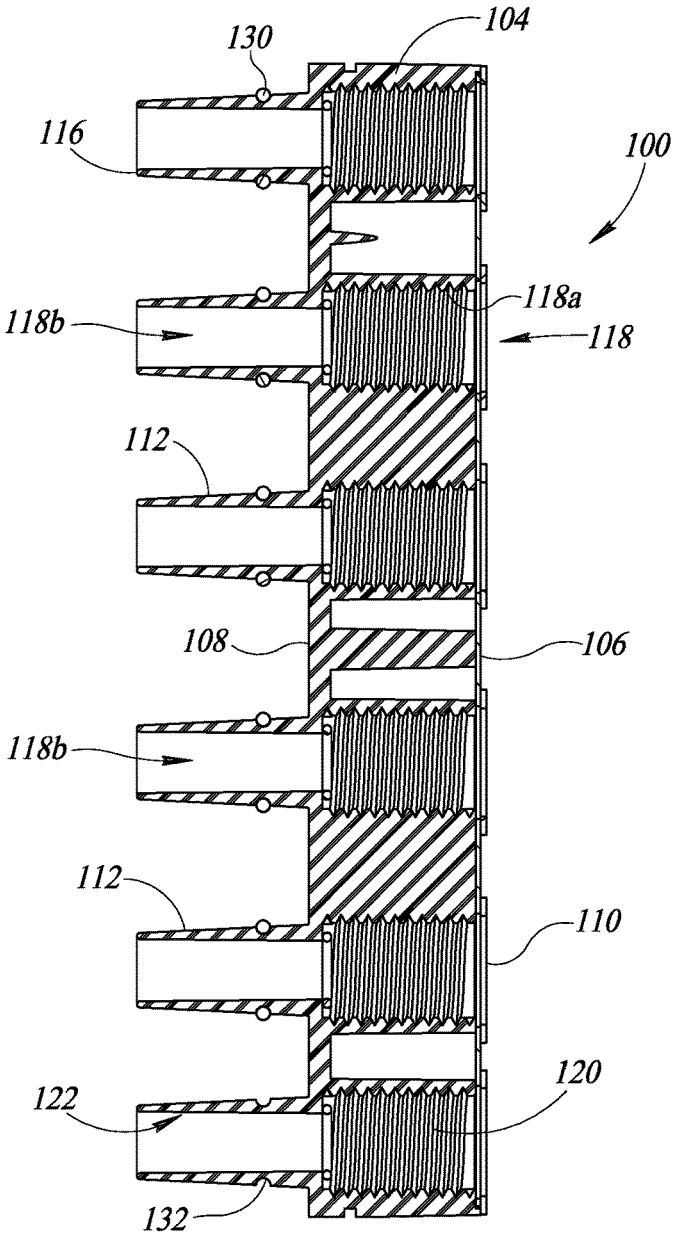
FIG. 1D is a schematic illustration of a cross-sectional view of the adapter of FIG. 1C.

Each adapter element 102 includes a through hole 118 extending from the coupling portion 110 at the first surface 106 of the main body 104 to the end surface 116 of the protrusion 112. Each through hole 118 is of suitable size and configuration to receive a connector as will be explained in reference to FIGS. 2A-2D. Each through hole 118 has a first portion **118*a* (Figured 1D) that is formed in the main body 104 and a second portion 118*b* that is formed in the protrusion 112 as best shown in FIG. 1D. The first portion 118*a* has a larger diameter than the second portion 118*b***.

The coupling portion 110 of each adapter element 102 is configured to couple with a corresponding connector. For instance, the coupling portion 110 of each adapter element 102 includes threads for coupling with threads of the connector. More particularly, the first portions **118*a* of the through holes 118 at the coupling portion 110 include threads that are configured to mate with threads of connectors that are received therein. The second portions 118*b* of the through holes 118** are configured to receive conductive leads of the connectors.

Each protrusion 112 includes an elastic sealing ring 130, such as an O-ring, around the outer surface of the protrusion 112. The elastic sealing rings 130 in FIGS. 1A-1D are each located closer to the base of the respective protrusion 112 than the end 116 of the protrusion 112; however, the elastic sealing rings 130 may be located in any position on the outer surface of the protrusions 112.

The outer surfaces of the protrusions 112 include recesses 132 to aid in holding the elastic sealing rings 130 in position. In particular, the elastic sealing ring 130 rests in the recess 132 when placed around the protrusion 112. FIG. 1D shows the last protrusion 112 without the elastic sealing ring 130 to illustrate the recess 132, while the remaining protrusions 112 in FIG. 1D include the elastic sealing rings 130 located in the recesses 132.

In FIGS. 1A-1D, six adapter elements 102 are coupled together in a single row to form the adapter 100; however, different embodiments of the adapter may include any number of adapter elements, including just one adapter element, and the adapter elements may be coupled to each other in other orientations than in a single row. In at least one embodiment, the adapter includes at least three adapter elements. In another embodiment, the adapter includes at least four adapter elements. Alternatively, in yet other embodiments, the adapter elements may be separated from each other and coupled individually to each connector to form individual assemblies.

The adapter 100 is made from an insulative material, such as a plastic material. In at least one embodiment, the adapter 100 is made from a molded plastic material and formed integrally.

Figure 2A:
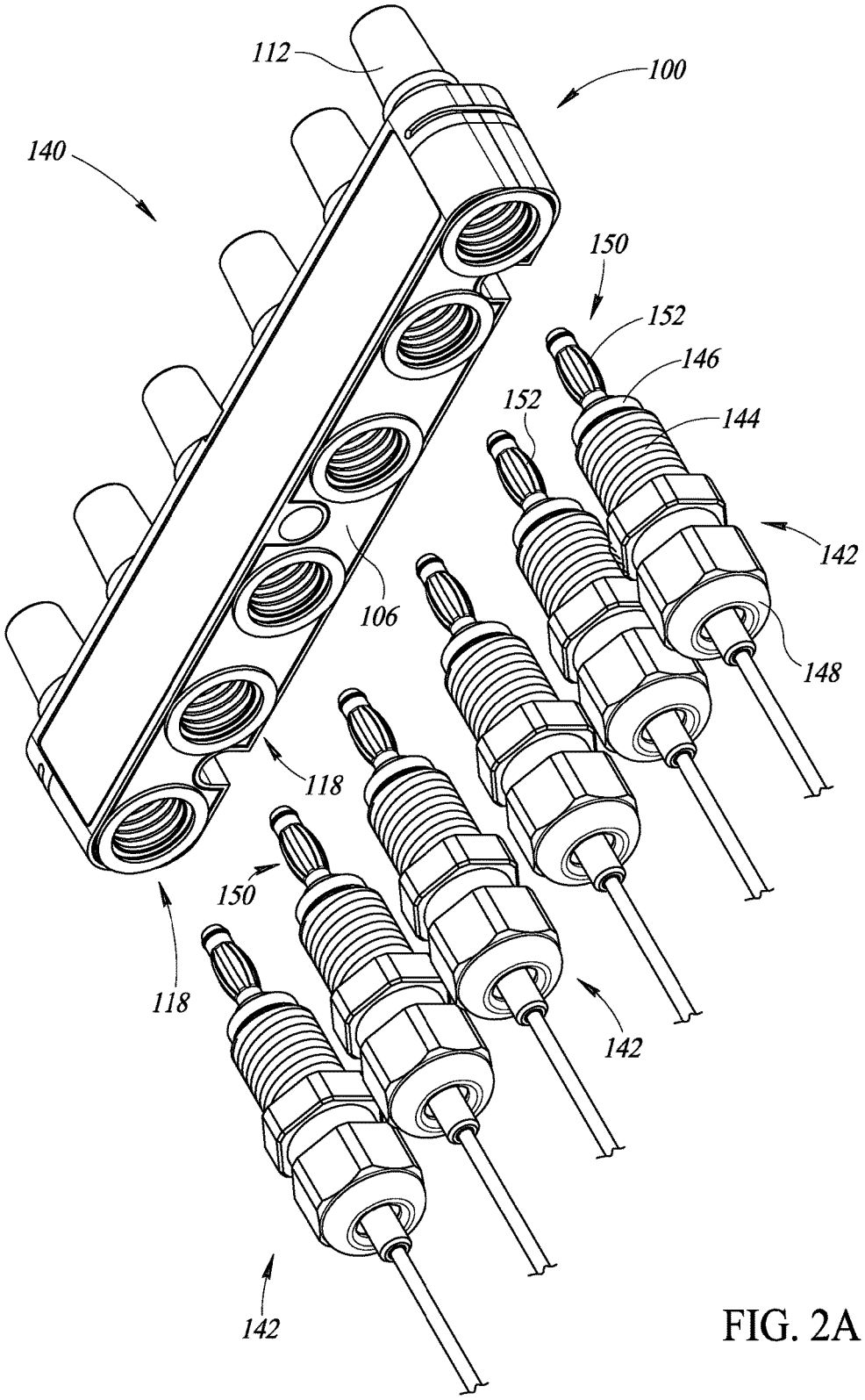
FIG. 2A is a schematic illustration of an exploded isometric view of a connector assembly that includes the adapter of FIG. 1A and a plurality of connectors.
Figure 2B:
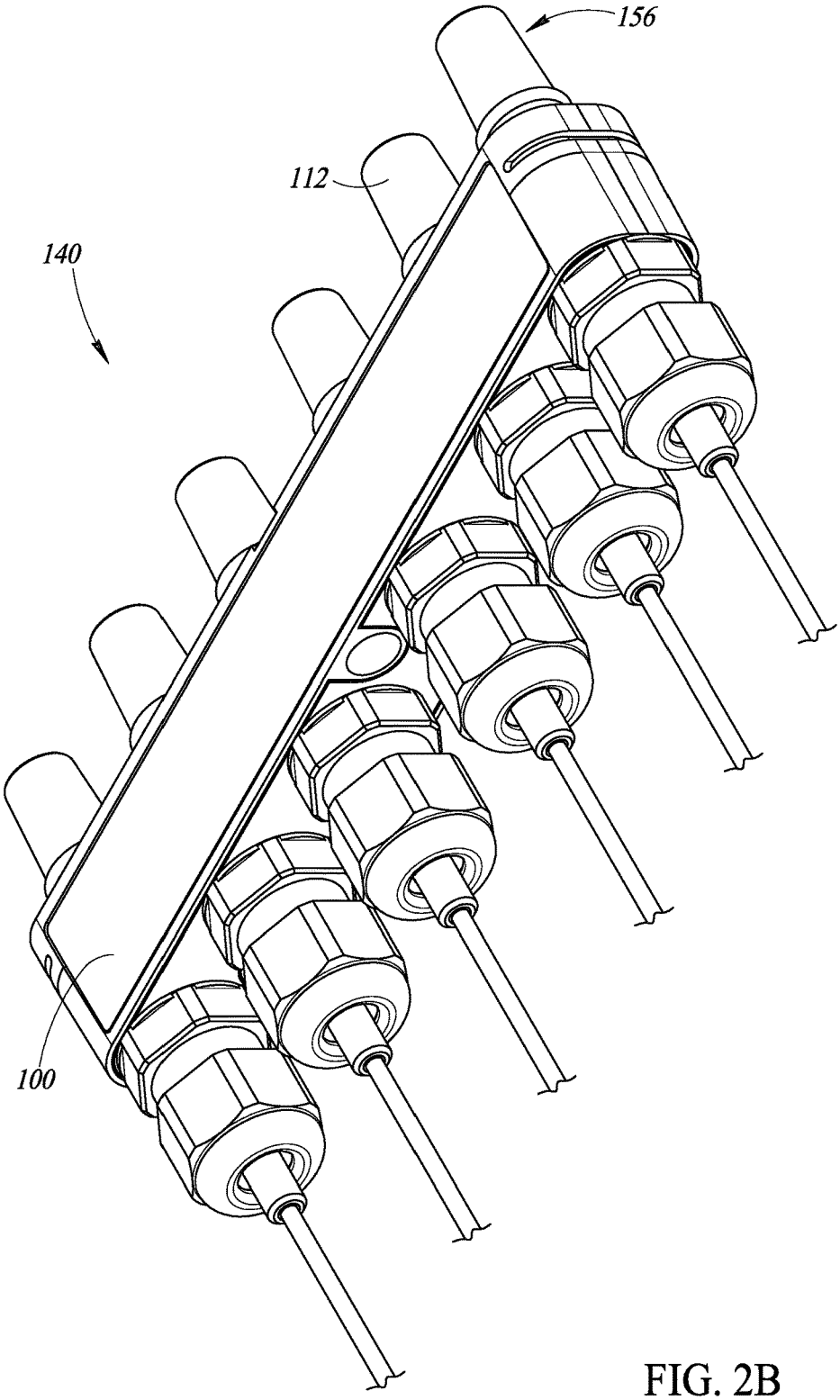
FIG. 2B is a schematic illustration of an isometric view of the connector assembly of FIG. 2A assembled.
Figure 2C:
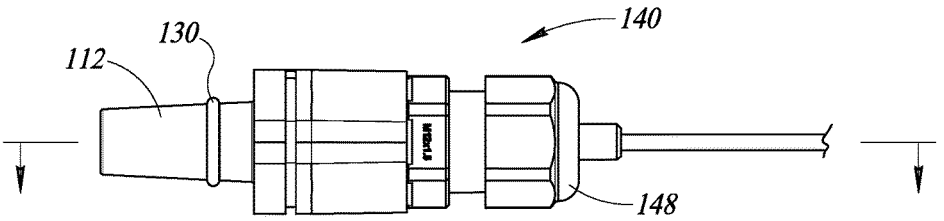
FIG. 2C is a schematic illustration of a side view of the connector assembly of FIG. 2B.
Figure 2D:
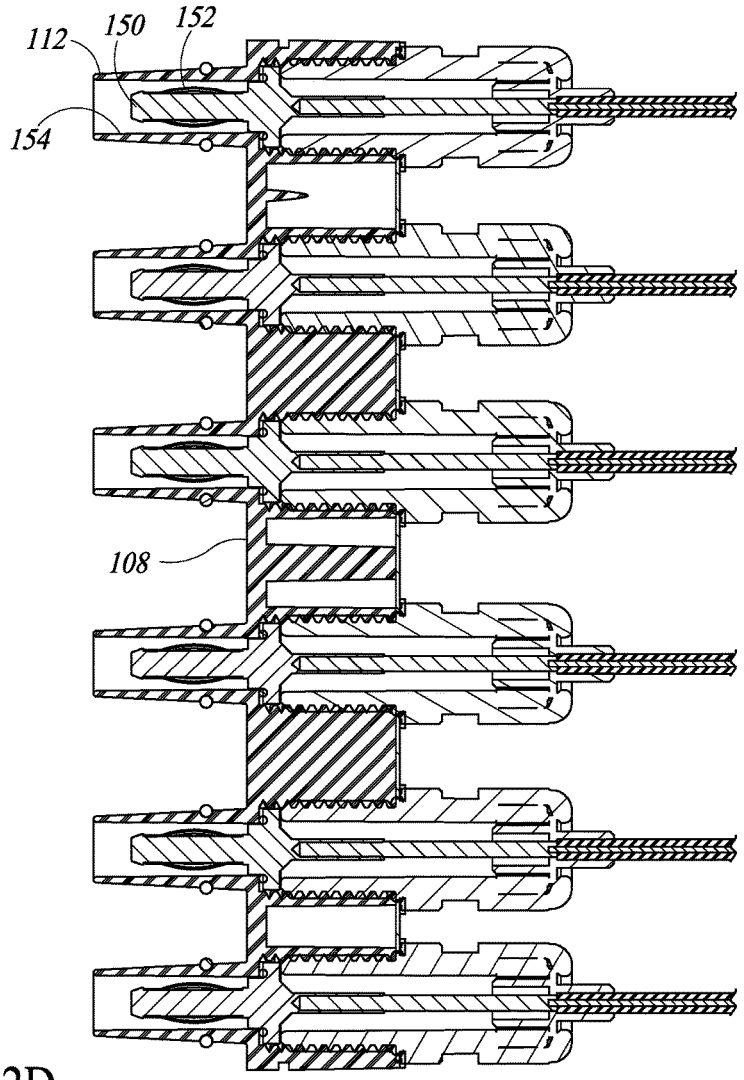
FIG. 2D is a schematic illustration of a cross-sectional view of the connector assembly of FIG. 2C.

FIGS. 2A-2D are various views of a connector assembly 140 that includes the adapter 100 of FIGS. 1A-1D in accordance with at least one embodiment. In particular, FIG. 2A is a schematic illustration of an isometric view of the connector assembly 140 prior to being assembled; FIG. 2B is a schematic illustration of an isometric view of the connector assembly 140 of FIG. 2A assembled; FIG. 2C is a schematic illustration of a side view of the connector assembly 140 of FIG. 2B; and FIG. 2D is a schematic illustration of a cross-sectional view of the connector assembly 140 of FIG. 2C.

The connector assembly 140 includes the adapter 100 of FIG. 1A-1D as well as a plurality of connectors 142. The plurality of connectors 142 may be conventional connectors. Generally described, each connector 142 has a housing 144, which may include various parts that will not be described in detail. The housing has a first end 146 and a second end 148. A conductive lead 150 is located inside the housing 144 and extends from the first end 146 of the housing 144. A conductive wire covered by insulative material extends from the second end 148 of the housing 144 of each connector 142. Only a portion of the conductive wires is shown. Ends of the conductive wires are coupled to various electrical components, such as power, voltage leads, current probes, etc.

To assemble the connector assembly 140, the connectors 142 are inserted into the through holes 118 of the adapter elements 102 in the orientation as shown in FIG. 2A. When assembled, the conductive leads 150 of the connectors 142 extend into the second portions 122 of the through holes 118, and the housings 144 of the connectors 142 are coupled to the first portions 120 of the through holes 118 as best shown in FIG. 2D. In particular, the threads of the housings 144 of the connectors 142 mate with the threads of the first portions 120 of the through holes 118 to hold the connectors 142 in the adapter elements 102. Thus, the connectors 142 are removably coupled to the first portions 120 of the through holes 118 of the adapter elements 102. When the connectors 142 are inserted into the through holes 118 of the adapter elements 102, a sealing may be provided between a surface of the respective connector 142 and an abutting surface of the corresponding coupling portion 110. The conductive leads 150 of the connectors 142 in the second portions 122 of the through holes 118 are preferably spaced apart from inner wall surfaces 154 of the protrusions 112.

Figure 3A:
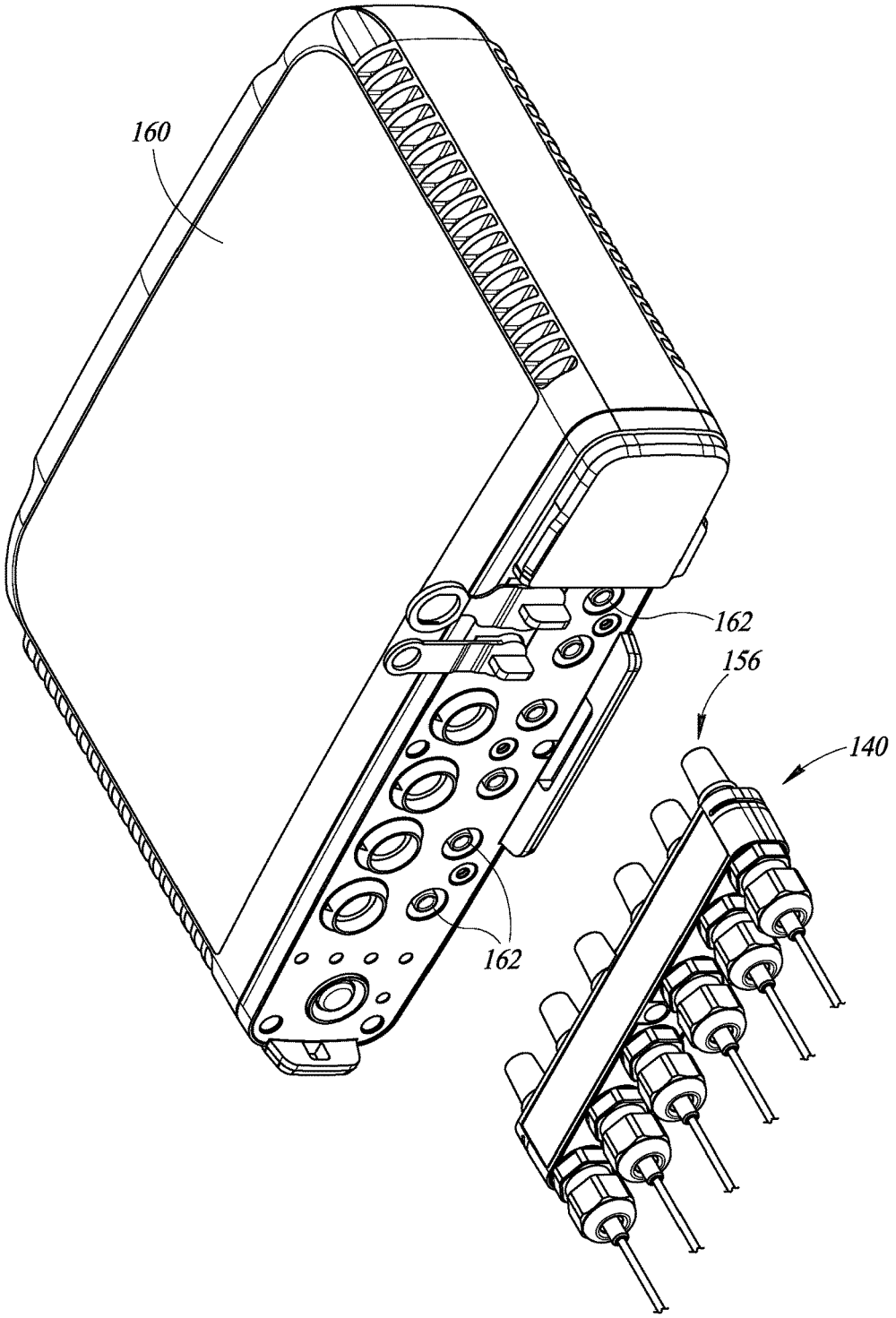
FIG. 3A is a schematic illustration of an isometric view of a system that includes the connector assembly of FIG. 2B prior to being inserted into sockets of an electronic device.
Figure 3B:
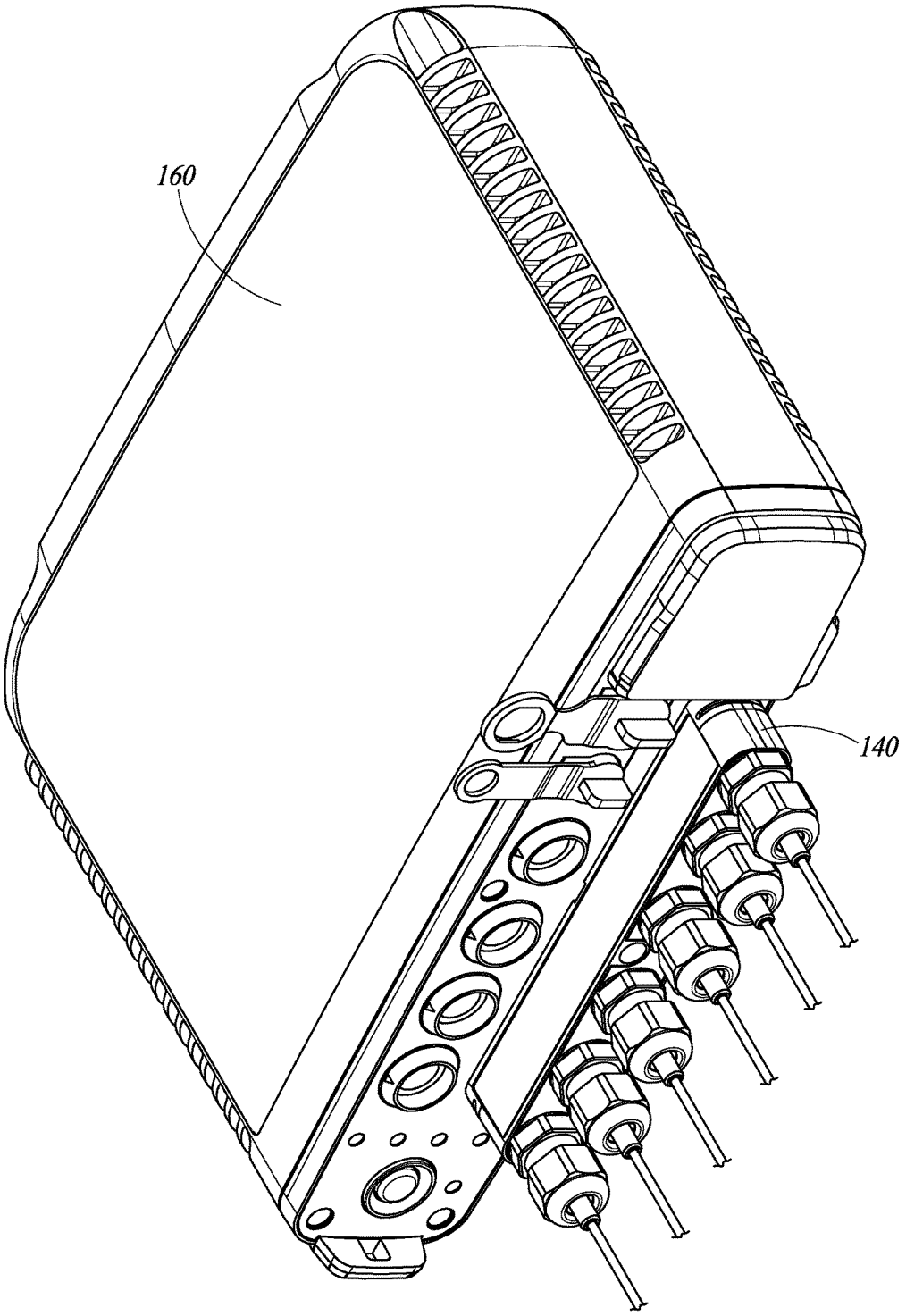
FIG. 3B is a schematic illustration of the system of FIG. 3A with the connector assembly of FIG. 2B inserted into the sockets of the electronic device.

When assembled, the connector assembly 140 is configured to be directly coupled to an electronic device 160 (e.g., as illustrated in FIGS. 3A and 3B). In particular, and as best shown in FIG. 2B, the connector assembly 140 includes an insertion end 156 for coupling with an electronic device 160. The insertion end 156 includes the conductive leads 150 of the connectors 142 and the protrusions 112 of the adapter 100 of the connector assembly 140.

Figure 3C:
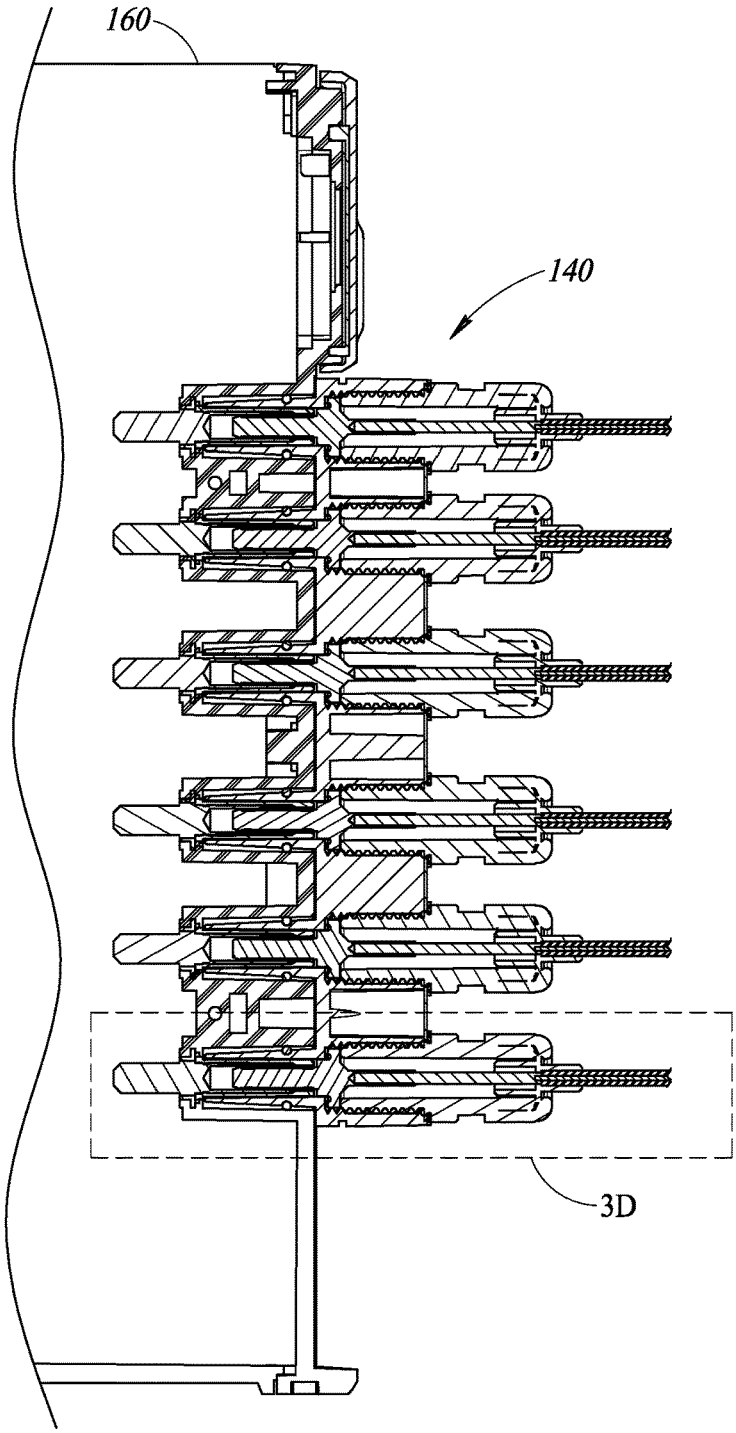
FIG. 3C is a schematic illustration of a partial cross-sectional view of the system of FIG. 3B.
Figure 3D:
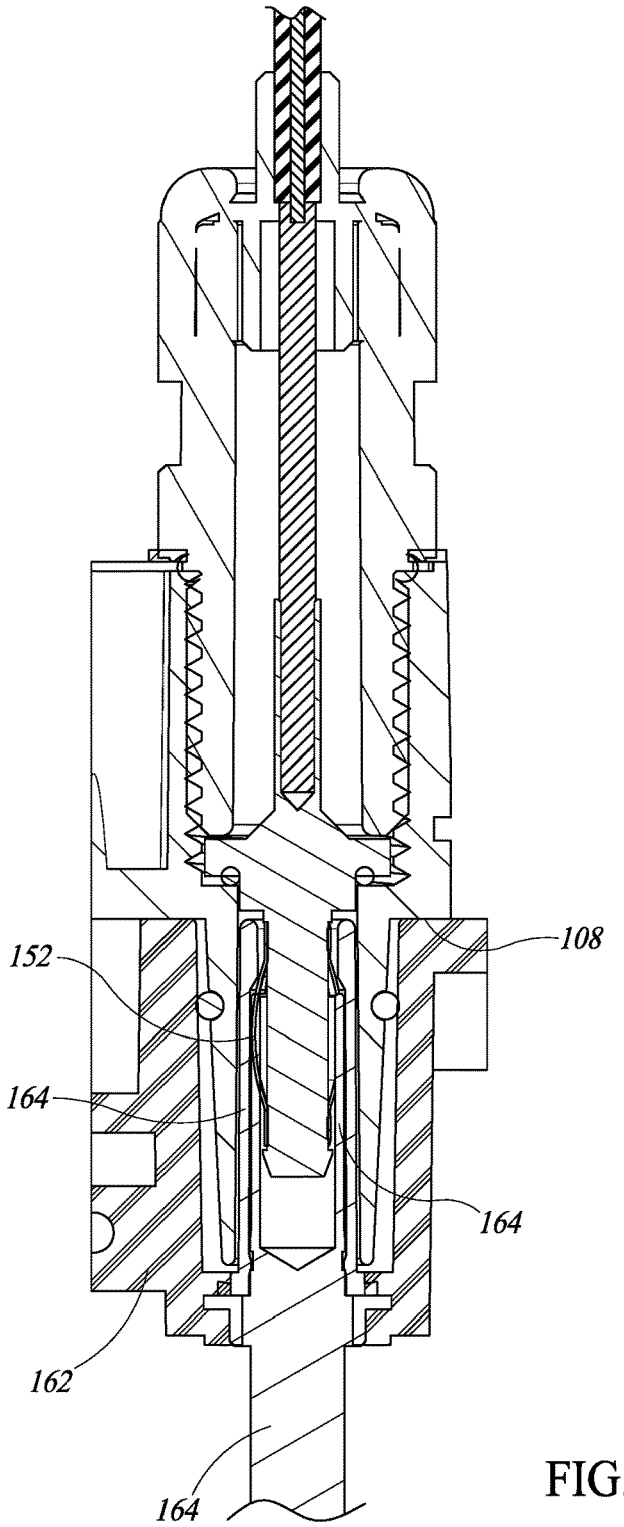
FIG. 3D is a schematic illustration of an enlarged cross-sectional view of a portion of the partial cross-sectional view of FIG. 3C.

FIGS. 3A-3D are various views of the connector assembly 140 of FIGS. 2A-2D coupled to an electronic device 160. In particular, FIG. 3A is a schematic illustration of an isometric view of an electronic device 160 and the connector assembly 140 prior to being coupled together; FIG. 3B is a schematic illustration of an isometric view of the connector assembly 140 coupled to the electronic device 160; FIG. 3C is a schematic illustration of a partial cross-sectional view of the electronic device 160 and the connector assembly 140 of FIG. 3B; and FIG. 3D is a schematic illustration of an enlarged cross-sectional view of a portion of FIG. 3C.

Generally described, the connector assembly 140 couples with the electronic device 160 to provide electrical coupling between the electronic device 160 and electrical components, such as power and measurements components, that are coupled to the connectors 142. When the insertion end 156 of the connector assembly 140 is inserted into sockets 162, the protrusions 112 of the adapter elements 102 extend around conductive elements 164, while the conductive leads 150 extend into an opening of the conductive elements 164. The conductive leads 150 of the connectors 142 electrically couple with the conductive elements 164 of the sockets 162 of the electronic device 160 as best shown in FIGS. 3C and 3D. More particularly, conductive springs 152 of the conductive leads 150 engage with the conductive elements 164 in the sockets 162 of the electronic device 160 to place the conductive leads 150 of the connectors 142 in electrical communication with the conductive element 164. Although not shown, the conductive elements 164 of the electronic device 160 are coupled to various electrical components of the electronic device.

Each elastic sealing ring 130 of the protrusions 112 abuts a surface of an inner wall of the corresponding socket 162. The elastic sealing ring 130 compresses between the protrusion 112 and the inner wall of the socket 162 to provide a seal therebetween. The sealing is of suitable amount that prevents fluid and/or particles above a particular size from being able to enter into the socket 162 to affect the conductive coupling between the corresponding conductive lead 150 and conductive element 164. As best shown in FIG. 3D, the second surface 108 of the adapter 102 abuts a surface of the electronic device 160 to form an abutting sealing surface, which further aids in preventing fluid and/or particles from traveling into the socket 162. Thus, the connector assembly 140 provides an improved level of protection between the connectors 142 and the sockets 162. In at least one embodiment, the protection provided by the adapter 102 improves the IP rating of the electronic device 160 to at least IP65 rating, which would not otherwise be achieved if the adapter 102 was not used and the connectors 142 were instead directly inserted into the sockets 162.

The coupling portion 110 of each adapter element 102 may include a sealing material, such as an elastic material, or a sealing material may be provided therebetween, to provide a sealing engagement with connectors 142 when the connectors 142 are inserted into the adapter elements 102 and a surface of the connectors 142 abuts the coupling portion 110.

The electronic device 160 may be any electronic device, including an electronic measurement device. In one embodiment, the electronic device 160 is an energy logger, which may operate outdoors. By using the connector assembly 140 with the electronic device 160, such as the energy logger, the IP ratings for the electronic device may thereby be improved. In particular, the IP rating for the energy logger with the connector assembly 140 is increased to an IP65 rating.

Furthermore by forming the adapter 100 with a plurality of adapter elements 102 connected together by a single integrated main body 104 such that the protrusions 112 of the adapter elements 102 are sized and spaced to match the size and spacing of sockets 162 on the electronic device 160, the connector assembly 140 may facilitate simultaneous electrical coupling of multiple connectors 142 to the multiple sockets 162, thus achieving a heightened IP rating for the electronic device 160, while also quickly coupling multiple connectors 142 with the respective sockets 162. Note also that an adapter with a plurality of adapter elements may still be used with the electronic device, even if less than all of the adapter elements are occupied by a corresponding connector. That is, only the connectors that are inserted in the adapter will mate with a corresponding socket.

The various embodiments described above can be combined to provide further embodiments. These and other changes can be made to the embodiments in light of the above detailed description. For instance, although the connectors are described as being configured to couple with the adapter element by threaded coupling methods, other coupling methods may be used. For instance, the connectors may be press fit into the adapter. Furthermore, the number of adapter elements of the adapter may correspond to the number of sockets to be used with the electronic device. Similarly, the spacing between adjacent adapter elements or the arrangement of adapter elements may correspond to the position and spacing of sockets on an electrical measurement device. Alternatively, individual adapter elements for each connector may be used. In that regard, the individual adapter element receives a single connector that forms a connector assembly for coupling to a socket.

In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A connector assembly, comprising:

an adapter including at least one adapter element having:

a coupling portion;

a protrusion coupled to the coupling portion, the protrusion including an outer surface;

a through hole extending through the at least one adapter element from the coupling portion to the protrusion; and a sealing ring located on the outer surface of the protrusion, wherein the sealing ring is configured to provide a sealing engagement between the outer surface of the protrusion and a socket of an electronic device when the protrusion is inserted in the socket of the electronic device; and a separate connector removably coupled to the coupling portion of the at least one adapter element, the connector including a lead located in the through hole, wherein a surface of the lead in the through hole is spaced apart from an inner surface of the protrusion.

2. The connector assembly of claim 1, wherein the adapter includes a plurality of adapter elements each coupled together by a main body, the connector assembly including a plurality of separate connectors, each of the plurality of connectors removably coupled to coupling portions of the plurality of adapter elements, respectively.

3. The connector assembly of claim 2, wherein the plurality of adapter elements is at least three adapter elements coupled together by the main body.

4. The connector assembly of claim 1, wherein the outer surface of the protrusion includes a recess, and wherein the sealing ring is located in the recess.

5. The connector assembly of claim 1, wherein the coupling portion includes threads configured to mate with threads of the connector to couple the connector to the coupling portion, and wherein a surface of the connector forms a seal with an abutting surface of the coupling portion.

6. A connector assembly comprising:

an adapter including at least one adapter element having:

a coupling portion;

a protrusion coupled to the coupling portion, the protrusion including an outer surface, wherein the protrusion has a base that is coupled to the coupling portion and an end that faces away from the coupling portion, and wherein the protrusion is tapered such that the base is wider than the end;

a through hole extending through the at least one adapter element from the coupling portion to the protrusion; and a sealing ring located on the outer surface of the protrusion; and a separate connector removably coupled to the coupling portion of the at least one adapter element, the connector including a lead located in the through hole, wherein a surface of the lead in the through hole is spaced apart from an inner surface of the protrusion.

7. A connector assembly comprising:

an adapter including at least one adapter element having:

a coupling portion;

a protrusion coupled to the coupling portion, the protrusion including an outer surface;

a through hole extending through the at least one adapter element from the coupling portion to the protrusion; and a sealing ring located on the outer surface of the protrusion; and a separate connector removably coupled to the coupling portion of the at least one adapter element, the connector including a lead located in the through hole, wherein a surface of the lead in the through hole is spaced apart from an inner surface of the protrusion, wherein the at least one adapter element includes an abutting surface, the protrusion extending from the abutting surface, and wherein the abutting surface is configured to abut a surface of a device when the connector assembly is coupled to the device and provide a sealing engagement between the connector assembly and the device.

8. An electronic device, comprising:

a socket including a conductive element that is electrically coupled to an electrical component of the electronic device;

an adapter having a protrusion, a coupling portion, and a through hole extending through the coupling portion and protrusion, the protrusion having an outer surface and a sealing ring located on the outer surface of the protrusion; and a separate connector removably inserted into the through hole of the adapter and forming a connector assembly, the connector including a conductive lead extending inside of the protrusion, wherein a portion of the connector assembly is inserted into the socket such that the conductive lead of the connector is electrically coupled to the conductive element of the socket, and wherein the sealing ring is compressed between an inner wall of the socket and the outer surface of the protrusion of the adapter and provides a sealing engagement with the inner wall of the socket.

9. The electronic device of claim 8, wherein the protrusion extends from a surface of the adapter, and wherein the surface of the adapter abuts a surface of the electronic device and provides a sealing engagement with the electronic device.

10. The electronic device of claim 8, wherein the outer surface of the protrusion includes a recess, and the sealing ring is located in the recess.

11. The electronic device of claim 8, further comprising a plurality of adapters, each of the plurality of adapters being coupled together within a main body.

12. The electronic device of claim 8, wherein the coupling portion of the adapter couples the connector to the adapter.

13. The electronic device of claim 8, wherein the adapter improves the sealing between the connector and the socket for the electronic device to attain at least an IP rating of IP65.

14. A connector assembly, comprising:

an adapter including a plurality of adapter elements coupled together by a main body, each of the plurality of adapter elements including:

a protrusion having an outer surface;

a through hole extending through the protrusion; and a sealing ring located on an outer surface of the protrusion, wherein the sealing ring is configured to provide a sealing engagement between the outer surface of the protrusion and a respective socket of an electronic device when the protrusion is inserted in the respective socket of the electronic device; and a plurality of separate connectors removably coupled to the plurality of adapter elements, respectively, the plurality of connectors including leads that are located in the through holes of the protrusions, respectively, wherein surfaces of the leads in the through holes are spaced apart from inner surfaces of the protrusions.

15. The connector assembly of claim 14, wherein the main body couples the plurality of adapter elements together in a single row.

16. The connector assembly of claim 14, wherein the plurality of adapters are at least three adapter elements, and wherein the main body couples adjacent adapter elements together.

17. The connector assembly of claim 14, wherein the plurality of connectors include threads and the plurality of adapter elements include corresponding threads, and wherein the plurality of connectors are coupled to the plurality of adapter elements by the corresponding threads.

18. The connector assembly of claim 14, wherein the outer surface of the protrusion of each of the plurality of adapter elements includes a recess, and wherein the sealing ring of each protrusion is located in the respective recess.

19. The connector assembly of claim 14, wherein the main body is integrally formed with the plurality of adapter elements.

20. The connector assembly of claim 14, wherein the sealing ring of each of the plurality of adapter elements is an O-ring.

* * * * *